United States Patent [19]

Pontoppidan

[11] Patent Number: 4,813,570

[45] Date of Patent: Mar. 21, 1989

[54] CONTAINER WITH REMOVABLE LID

[75] Inventor: Eskild Pontoppidan, Copenhagen, Denmark

[73] Assignee: Kold Plast A/S, Vordingborg, Denmark

[21] Appl. No.: 163,705

[22] Filed: Feb. 12, 1988

[30] Foreign Application Priority Data

Feb. 19, 1987 [DK] Denmark ..... 855/87

[51] Int. Cl.[4] ..... B65D 41/16; B65D 41/18

[52] U.S. Cl. ..... 220/306; 215/224

[58] Field of Search ..... 220/306; 215/224, 317, 215/321

[56] References Cited

U.S. PATENT DOCUMENTS 4,124,134 11/1978 Montgomery ..... 215/224
4,449,638 5/1984 Davis ..... 215/224

FOREIGN PATENT DOCUMENTS 1185985 1/1965 Fed. Rep. of Germany .
2178732 2/1987 United Kingdom .

*Primary Examiner*—George T. Hall
*Attorney, Agent, or Firm*—Oblon, Fisher, Spivak, McClelland & Maier

[57] ABSTRACT

Disclosed is a container (1) is provided with a removable lid (2). At the top of the side wall of the container there is provided an outwardly projecting bead or bead portions (5, 5', 5'') abutted by the lid (2) the lid having a skirt (2a) with downwardly and/or inwardly facing cams (10, 11, 12, 15, 16, 17). The lid (2) is relatively stiff, and the inside of the skirt (2a) has a concave abutment surface (2a') near its lower edge portion, the abutment surface being of a substantially spherical, conical or superelliptical curvature and abutting the bead or bead portions (5, 5', 5''). The side wall of the container is provided with a support shoulder (7) beneath the bead or bead portions (5, 5', 5''). The cams are partially snap cams (10, 11, 12) mounted beneath the abutment surface (2a') and adapted to catch the abutment surface (2a') of the skirt when it abuts the bead or bead portions (5), and partially one or more small fulcrum cams (16, 17) projecting inwardly or downwardly seen from the lower edge portion of the skirt (2a) and optionally extending along a considerable angle. The fulcrum cams (16, 17) are of such a height (h) and are arranged with respect to the snap cams (10, 11, 12) in such a way that they allow at least one of the snap cams to be released from the snapped engagement with the bead or the bead portions (5, 5', 5'') when the lid (2) is tilted around two of the fulcrum cams, while they are made to abut the support shoulder (7).

12 Claims, 6 Drawing Sheets

CONTAINER WITH REMOVABLE LID

BACKGROUND OF THE INVENTION

1. Field of the Invention

The invention relates to a container with a removable lid, said container having a side wall at the top of which there is provided an outwardly projecting bead or bead portions abutted by the lid, said lid having a skirt with downwardly and/or inwardly facing cams.

2. Discussion of the Background

In a known container with a removable lid the top of the side wall of the container is provided with an outwardly facing, circular bead against which bead the lid abuts, as the lid has a skirt, the inside of said skirt being provided with cams facing radially inwardly. These cams are, however, mounted rather high so that they press against the bead from above when the lid covers the container. A normal person wishing to open or close the known container has difficulties doing so. A person with a handicapped hand, for example caused by arthritis or the like, a person with impaired vision or a blind person is unable to remove or replace the known lid if the container is to be operated with one hand only. When the lid is to be removed all cams slide too easily away from the bead. The lid cannot be removed with all phases of the operation being sufficiently under control.

In another known container with removable lid the top of the side wall is provided with a circular, outwardly facing bead and the skirt of the lid has a circular inwardly facing bead, the latter being engageable beneath the bead of the container. This container does not work quite satisfactorily for the above-mentioned group of handicapped people as it is difficult or impossible to remove the lid with a handicapped hand. The inwardly facing bead of the skirt simply fastens the lid too well.

SUMMARY OF THE INVENTION

The object of the invention is to provide a container with removable lid of the above type, enabling a person with a handicapped hand, a person with impaired vision or a blind person to remove the lid from the container at any time in a controlled manner. The term "controlled manner" signifies that a user is able to control the lid and/or container so that these do not suddenly slip from the user's grasp during the removal of the lid.

If the container with a lid according to the invention the lid is relatively stiff, and the inside of the skirt has a concave abutment surface near its lower edge portion, said abutment surface being of a substantially spherical, conical or superelliptical curvature and abutting the bead or bead portions, and the side wall of the container is provided with a support shoulder beneath the bead or bead portions. The cams are partially snap cams mounted beneath. the abutment surface and are adapted to catch the abutment surface of the skirt when it abuts the bead or bead portions. Partial portions, one or more small fulcrum cams project inwardly or downwardly seen from the lower edge portion of the skirt and optionally extend along a considerable angle, said fulcrum cams being of such a height and arranged with respect to the snap cams in such a way that they allow at least one of the snap cams to be released from the snapped engagement with the bead or the bead portions when the lid is tilted around two of said fulcrum cams, while they are made to abut the support shoulder. As a result a user is able to remove the lid from the container in a controlled manner using only one hand and the force of his or her fingers. This is due to the removal being performed by means of the user first pressing the lid down with slight pressure so that two substantially opposite fulcrum cams are made to abut the support shoulder, whereupon the user presses a carpus against the edge of the lid at a predetermined place. As a result the lid tilts around the two fulcrum cams as a well-defined lever and the part of the lid farthest away from the carpus is raised, as a snap cam is released from its hold of the bead or bead portion. The stability of the lid and the container during the opening is especially due to the fact that during the opening of the container the user is able to press one half of the lid against the support shoulder of the container, while the other half of the lid is released with a little click (as the mentioned snap cam is released from the bead or bead portion). The abutment surface of the skirt slides over the bead of the container while a snap cam is released.

The inventive bead or bead portions of the side wall of the container are provided with a slightly curved, upwardly-outwardly facing surface, preferably as part of a sphere, cone or superellipsoid. Thus an especially tight seal between the skirt of the lid and the container is obtained without running the risk of the lid getting stuck during its removal.

Furthermore, the inventive bead or bead portions are provided with a downwardly-outwardly facing, conical surface, the peak of said cone facing downwards, and each snap cam is provided with an inwardly facing ridge. As a result, the hold of the individual snap cam beneath the bead or bead portion is very reliable thus keeping the lid firmly on the container. The retaining force is, however, not stronger than the pressure necessary to release a snap cam from the bead or bead portion with a little clock when the lid is exposed to such a pressure at a place opposite the snap cam.

Moreover, the inventive bead or bead portion are formed by providing the side wall of the container with an outer, circular groove at a distance from the top. As a result the container is of a simple design and thus easy to manufacture.

According to the invention, the side wall of the container is of a uniform thickness, and the support shoulder is situated on an outward projection circumferential in relationship to the container. This embodiment is especially suitable.

In another embodiment of the invention the skirt is of such a length that a small gap is provided between the lower edge portion of the skirt and the support shoulder and a further small gap is provided radially inside said edge when the abutment surface of the skirt abuts the bead or bead portions. As a result it is ensured that the lid is stopped during the opening of the container, when it has been turned at a suitable angle, since the skirt edge farthest away from the snap cam released from the bead or bead portion is made to abut against the support shoulder.

In a further embodiment of the invention the snap cams are arranged at "around 3o'clock", "around 7 o'clock", and "around 11 o'clock" while the fulcrum cams are arranged at "around 3 o'clock", "around 6 o'clock" and "around 12 o'clock", the lid representing the face of a clock. These positions of the snap cams and fulcrum cams ensure an especially reliable removal of the lid.

The inventive fulcrum cam in position "around 12 o'clock" is in the interval "10 o'clock" to "1 o'clock"

and the inventive fulcrum cam in position "around 6 o'clock" is in the interval "5 o'clock" to 8 o'clock". These positions are especially suitable.

In another embodiment of the invention the upper side of the lid has a mark, preferably a slight, easily visible of perceptible depression, diametrically opposite the projecting snap cam at the opening of the lid. Thus, when touching the lid the user is readily able to detect where to press with one hand if he or she wishes to remove the lid.

In yet another embodiment of the inventive container the fulcrum cams on the skirt of the lid are replaced by at least two upwardly facing supplementary fulcrum cams on the support shoulder. Thus a very reliable removal of the lid is also ensured, where the user knows to be in control of the lid at any given time, especially with regard to the tilting movement of the lid when the lid tilts around the two supplementary fulcrum cams.

In yet a further embodiment of the inventive container the support shoulder is avoided, and the fulcrum cams are positioned inside the lid above the abutment surface. This enables the lid to be removed "slidingly", as the lid is able to slide down the bead or bead portions when the user has forced a snap cam to be released from the bead or bead portion with one hand. Simultaneously the lid is rotated around substantially diametrically opposed, moving fulcrums.

According to the invention the lid has an inner enlargement, such as a rib, serving as a stop means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
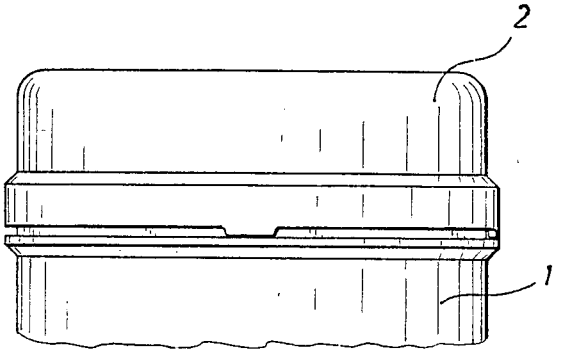
FIG. 1 is a side view of a first embodiment of the inventive container with a removable lid.

FIG. 1 illustrates a container 1 provided with a removable lid 2. The top of the container has an outwardly facing bead 5, while the lid has a skirt 2*a* provided with several inwardly facing cams further described below, cf. FIG. 3.

The lid 2 is comparatively stiff and the inside of the skirt 2*a* of said lid 2 is provided with a concave abutment surface 2*a'* near its lower edge portion, said abutment surface being of a substantially spherical, conical or superelliptical curvature and abutting the bead 5. The cams include snap cams 10, 11, 12, cf. FIG. 4, mounted beneath the abutment surface 2*a'* of the skirt 2*a*. When the abutment surface 2*a'* of the skirt abuts the bead 5 the snap cams catch hold of said bead.

Figure 4:
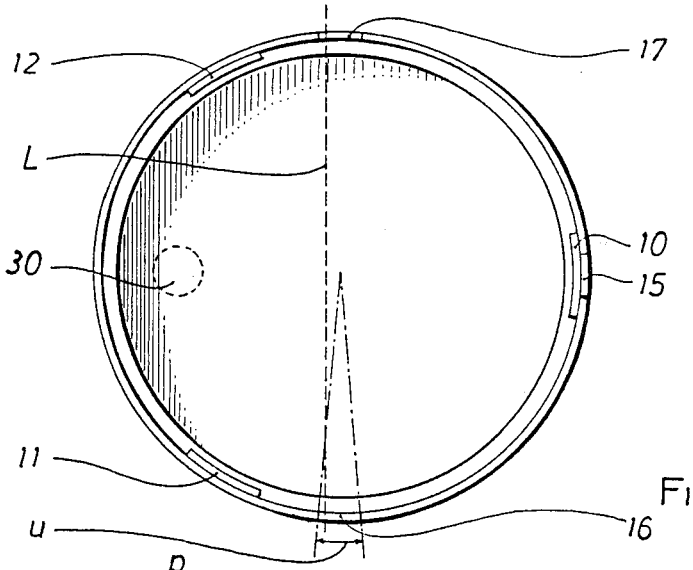
FIG. 4 is a bottom view of the lid of FIG. 3.
Figure 5:
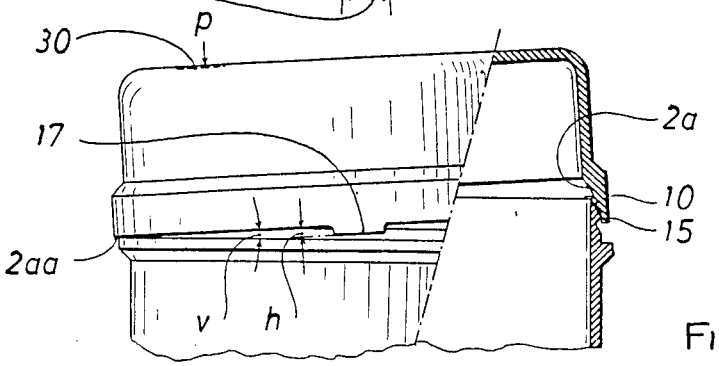
FIG. 5 is an external view of the container and lid of FIG. 3 (one part, however, being a sectional view) with the lid tilted so far that a snap cam is released from the bead of the container.

Furthermore the cams include cam 15 and fulcrum cams 16 and 17, cf. FIGS. 4 and 5, projecting down from the lower edge portion of the skirt. Optionally they extend along a considerable angle u, cf. FIG. 4. If necessary, u may be up to 180°, optionally so that the fulcrum cams form a continuous, downwardly projecting edge. The fulcrum cams are of such a height h and thus of such a small distance from the support shoulder 7 that a user is easily able to create a suitably large torque around the line L of the fulcrum cams when the hand of the user excerts a slight pressure against the lid 2, for example as shown by reference number 30 in FIG. 5.

Since the individual snap cam excerts only a small force for retaining the lid on the container, the above torque makes the snap cam—here snap cam 10—release the bead 5 of the container with a clearly audible, little click. Simultaneously with the snap cam 10 being released from the bead 5, cf. FIG. 5, the part 2*aa* of the skirt 2*a* of the lid opposite the snap cam 10 is made to abut the support shoulder so that the user is able to notice that the lid and the container have not lost contact when the lid is suddenly released at the snap cam 10. Such a loss of contact may result in the parts of the container slipping from the user's grasp. At the moment the snap cam 10 is released and during the period directly afterwards the lid is "controlled" by the fulcrum cams 16 and 17 as well as parts of the bead 5, since these parts abut the abutment surface 2*a'*. Subsequent to rotating the lid around an angle v the skirt edge 2*aa* is supported by the support shoulder 7, as mentioned above. The individual cam may extend along a considerable angle u, such as 15°–25°, preferably about 20°, cf. FIG. 4. The fulcrum cams 15, 16, and 17 are comparatively small (of little height). Instead of projecting downwardly they project radially inwardly and instead of abutting the support shoulder 7 they may abut the upper side of the bead of the container.

Owing to the reliable control of the lid during the removal of the inventive container with a lid the especially suitable for people with handicapped arms or hands, such as people suffering from arthritis. An arthritic user unable to move his or her wrist is able to remove the lid by placing the forearm on it, slightly tilting the forearm and simultaneously excerting a vertical pressure P on the place 30, cf. FIG. 5. People with impaired vision on blind people also profit from the inventive container, since they are no longer required to fumble with the lid in order to remove it.

Figure 6:
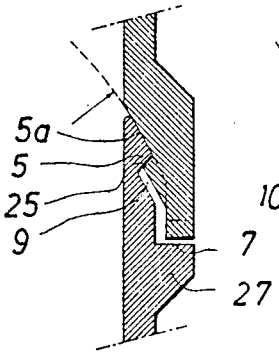
FIG. 6 is a vertical sectional view of the upper part of the side wall of the container as well as part of the skirt of the lid, with the upwardly-outwardly facing surface of the bead on the side wall of the container as well as the groove below the bead and the support shoulder clearly visible.

As shown in FIG. 6 the bead may have an upwardly-outwardly facing surface 5*a*, preferably curved as part of a sphere, cone or superellipsoid. The curvature of FIG. 6 is spherical with a radius R, and the center of the curvature is on the axis of the container.

Figure 7:
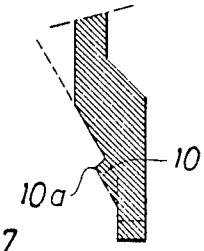
FIG. 7 is a detailed view of the part of the skirt of the lid of FIG. 6.

The bead 5 may be provided with a downwardly-outwardly facing conical surface 25, the peak of said cone facing downwards. Each snap cam may be provided with a well-defined ridge 10*a*, helping to ensure that the sap cam is released from the bead 5 with a little click when the lid is tilted, cf. FIG. 7.

Figure 8:
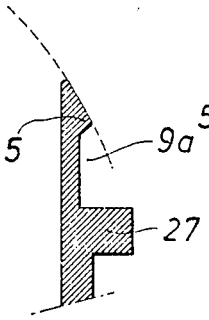
FIG. 8 is a cross-sectional view of the upper part of the side wall of the container with the circumferential groove having a slightly different shape.
Figure 9:
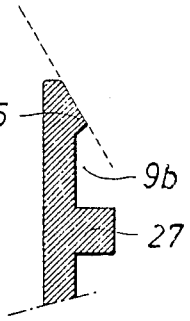
FIG. 9 is a cross-sectional view of the upper part of the side wall of the container, said groove again having a different shape.

The bead is formed by providing the side wall of the container with an outer, circular groove 9 at a distance from its upper edge, cf. FIG. 6. This groove may also have other shapes, shown for example at 9*a*, 9*b* or 9*c* in FIGS. 8, 9 and 10 respectively.

As shown in FIGS. 6, 8, 9 and 10, the support shoulder 7 may be situated on an outward projection 27 circumferential in relation to the container.

Figure 3:
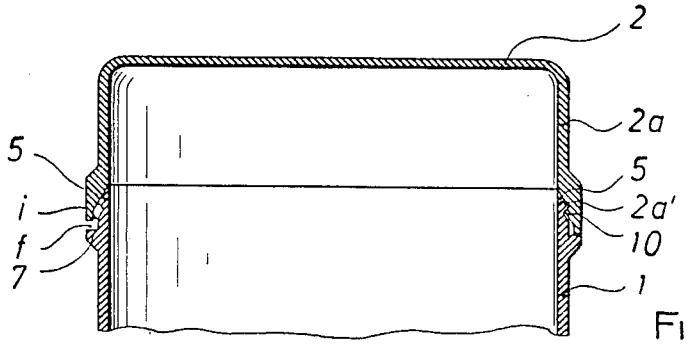
FIG. 3 is a sectional view along line III—III of FIG. 2.

The skirt of the lid is of such a height that a small gap f is provided between the lower edge portion of the skirt and the support shoulder 7 and a further little gap is provided radially inside said edge, cf. left side of FIG. 3.

FIG. 4 shows how the snap cams 10, 11 and 12 are arranged, the lid representing the face of a clock, i.e. they are positioned at "around 3 o'clock", "around 7 o'clock", and "around 11 o'clock" while the fulcrum cams 15, 16 and 17 are positioned at "around 3 o'clock", "around 6 o'clock" and "around 12 o'clock". In a preferred embodiment the fulcrum cam 17 in position "around 12 o'clock" is in the interval "10 o'clock" to "1 o'clock" and the fulcrum cam 16 in position "around 6 o'clock" is in the interval "5 o'clock" to "8 o'clock". The fulcrum cams 16 and 17 are, however, arranged in such a way that only one snap cam is released in the first phase of the removal of the lid.

Figure 2:
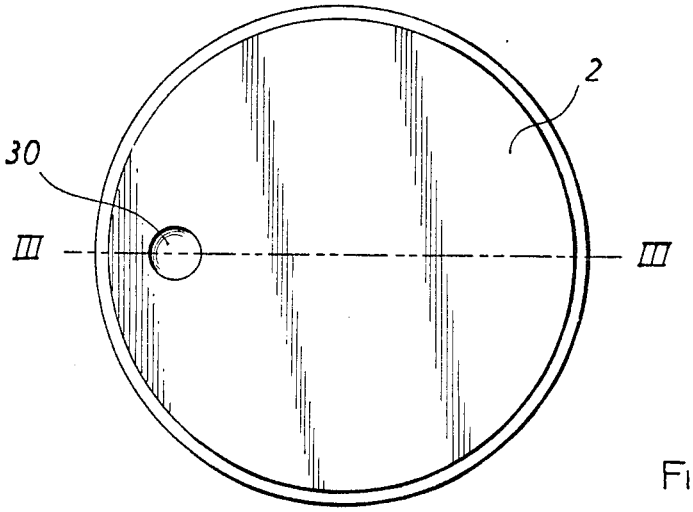
FIG. 2 is a top view of the embodiment of FIG. 1

At its edge or in the middle between two subsequent snap cams, cf. FIGS. 2 and 4, the upper side of the lid 2 may be provided with a mark 30, preferably in form of a slight, easily visible or perceptible depression indicating where the lid has to be pressed in order to remove it.

Figure 10:
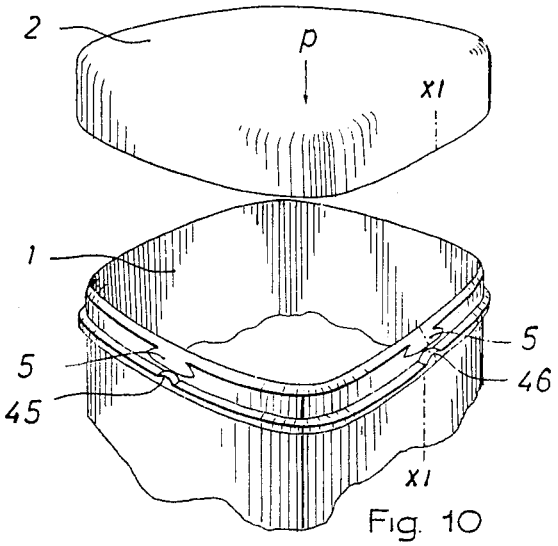
FIG. 10 is a perspective view of a container with a removable lid, both being of substantially superelliptical cross-section, and the support shoulder of the container being provided with supplementary fulcrum cams.
Figure 11:
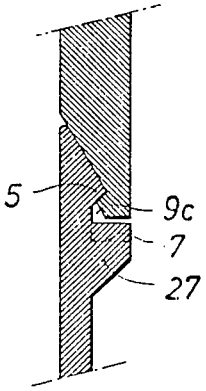
FIG. 11 is a cross-section along line XI—XI of FIG. 10 with the lid in place.

The container may be of a substantially superelliptical cross-section, cf. FIGS. 10 and 12 *a–d*. Furthermore, the support shoulder may be provided with two upwardly facing supplementary cams, suggested in FIGS. 11 and 12*d* at 45 and 46. In this case the downwardly facing fulcrum cams at the skirt of the lid mentioned above may be avoided.

Figure 12A:
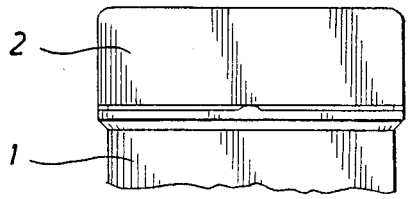
FIGS. 12*a*, 12*b*, 12*c* and 12*d* are a side view with lid in place, a cross-sectional view, a top view and a side view turned 45° respectively of the container of FIG. 11; wherein in FIG. 12*d* the lid is tilted.
Figure 12B:
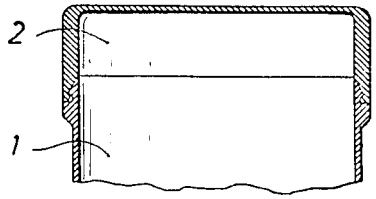
Figure 12C:
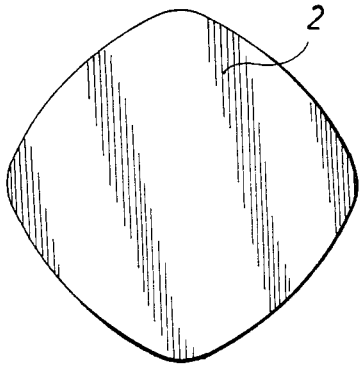
Figure 12D:
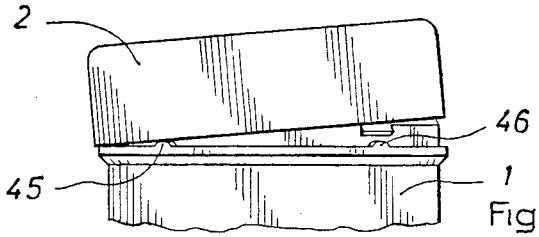
Figure 13A:
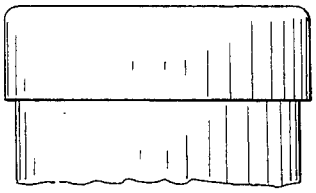
FIGS. 13*a*, 13*b*, 13*c*, 13*d* and 13*e* are a side view, a cross-sectional view with the lid in place, a cross-sectional view with the lid tilted and a top view respectively of a container with a removable lid, wherein the support shoulder of the upper part of the side wall of the container is avoided, as well as a bottom view of the lid.
Figure 13B:
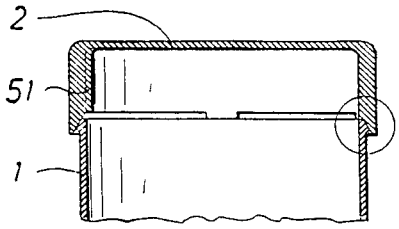

Instead of or supplementary to a continuous, circumferential bead 5 on the container 1, said container may be provided with several separate bead portions 5', 5'', such as shown in FIGS. 10 and 12*d*.

The lid of the container is suitably manufactured by injection moulding.

Figure 14:
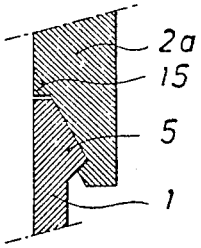
FIG. 14 is an enlarged, detailed view of the cross-sectional view of FIG. 13*b*, FIGS. 15*a*, 15*b*, 15*c* and 15*d* are a side view, a cross-sectional sectional view with the lid in place, a cross-sectional view with the lid tilting around the fulcrum cams and a cross-sectional view with the lid tilted such that the fulcrum cams are released from the support shoulder respectively of the container with the removable lid of FIGS. 1–5.
Figure 13C:
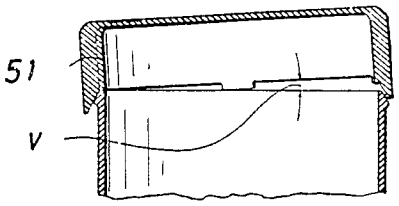
Figure 13D:
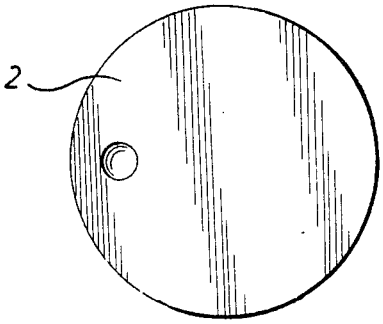
Figure 13E:
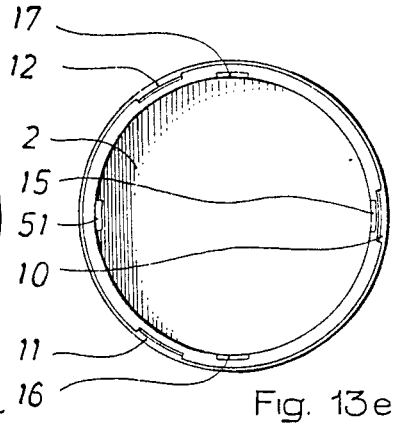

Optionally the support shoulder of the container may also be avoided. This is clearly shown in the embodiments of FIG. 13, cf. especially 13*b*, and FIG. 14. The fulcrum cams 15, 16 and 17 are arranged inside and directly above the abutment surface 2*a'* of the skirt 2*a*, thus being able to use the upper edge of the container as a support shoulder.

If the fulcrum cams 16 and 17 are arranged in position 5 "around 6 o'clock" and "around 12 o'clock" and the fulcum cam 15 is arranged in position "3 o'clock", the inside of the skirt 2*a* of the lid is provided with an enlargement at position "9 o'clock", such as a stopping rib 51. During opening this rib is made to abut the upper edge of the container, cf. FIG. 13*c*, when the lid is tilted around the angle v. In this position the lid is loosely fixed above the bead 5 of the container, thus ensuring that the user does not lose his or her grasp of the lid and the container.

Figure 15A:
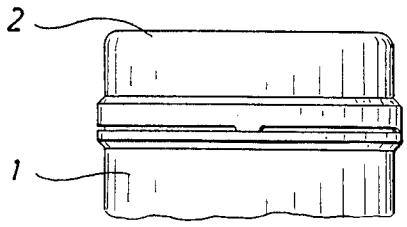
Figure 15B:
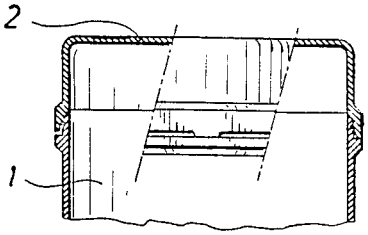
Figure 15C:
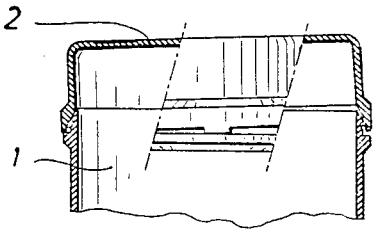
Figure 15D:
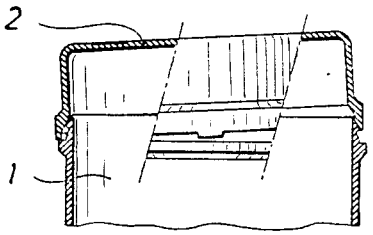

FIGS. 15*a–d* show the container of FIGS. 1–5 with a lid in greater detail. In FIGS. 15*a* and 15*d* the lid is in place. In FIG. 15*c* one snap cam is released, as the lid is tilted around the fulcrum cams. In FIG. 15*d* the lid is lifted so much that the fulcrum cams are released.

The container with a removable lid may be varied in many ways without deviating from the scope of the invention.

What is claimed as new and desired to be secured by Letters Patent of the United States is:

1. A container with a removable lid (2), said container having a side wall at the top of which there is provided an outwardly projecting bead means (5, 5', 5'') abutted by the lid (2), said lid having a skirt (2*a*) with downwardly and/or inwardly facing cams (10, 11, 12, 15, 16, 17) wherein the lid (2) is relatively stiff, and the inside of the skirt (2*a*) has a concave abutment surface (2*a'*) near its lower edge portion, said abutment surface being of a substantially spherical, conical or superelliptical curvature and abutting the bead means (5, 5', 5''), the side wall of the container is provided with a support shoulder (7) beneath the bead means (5, 5', 5''), the cams comprise snap cams (10, 11, 12) mounted beneath the abutment surface (2*a'*) and adapted to catch the abutment surface (2*a'*) of the skirt when it abuts the bead means (5), and one or more small fulcrum cams (16, 17) projecting inwardly or downwardly as seen from the lower edge portion of the skirt (2*a*), said fulcrum cams (16, 17) being of such a height (h) and arranged with respect to the snap cams (10, 11, 12) in such a way so as to allow at least one of the snap cams to be released from snapped engagement with the bead means (5, 5', 5'') when the lid (2) is tilted around two of said fulcrum cams, while being made to abut the support shoulder (7).

2. A container as in claim 1, wherein the bead means (5, 5', 5'') of the side wall of the container are provided with a slightly curved, upwardly-outwardly facing surface (5a).

3. A container as in claim 1, wherein the bead means (5) are provided with a downwardly-outwardly facing, conical surface (25), a peak of said conical surface facing downwards, and wherein each snap cam (10, 11, 12) is provided with an inwardly facing ridge (10*a*).

4. A container as in claim 1, wherein the bead means (5) are formed by providing the side wall of the container with an outer, circular groove (9, 9*a*, 9*b*) at a distance from the top.

5. A container as in claim 1, wherein the side wall of the container is of uniform thickness, and the support shoulder (7) is situated on an outward projection (27) circumferentially in relationship to the container.

6. A container as in claim 1, wherein the skirt (2*a*) is of such a length that a small gap (f) is provided between the lower edge portion of the skirt and the support shoulder (7) and a further small gap (i) is provided radially inside said edge when the abutment surface (2*a*′) of the skirt abuts the bead means (5).

7. A container as in claim 1, wherein the snap cams (10, 11, 12) are arranged at approximately a 3 o'clock position, approximately a 7 o'clock position, and approximately an 11 o'clock position, while the fulcrum cams (15, 16, 17) are arranged at approximately a 3 o'clock position, arpproximately a 6 o'clock position and approximately a 12 o'clock position when the lid is viewed as a clock.

8. A container as in claim 1, wherein the fulcrum cam (17) when in approximately a 12 o'clock position is in an interval of from 10 o'clock to 1 o'clock and the fulcrum cam (16) in approximately 6 o'clock position is in an interval from 5 o'clock to 8 o'clock when the lid is viewed as a clock.

9. A container as in claim 1, wherein the upper side of the lid (2) has a mark (30) diametrically opposite the projecting snap cam (10) at the opening of the lid.

10. A container as in claims 1 or 9, wherein the support shoulder (7) is provided with at least two upwardly facing supplementary fulcrum cams (46. 46).

11. A container as in claim 1 wherein the fulcrum cams (16, 17) are positioned inside the lid above the abutment surface (2*a*′).

12. A container as in claim 11, wherein the lid has an inner enlargement serving as stop means.

* * * * *